US005816909A

United States Patent [19]

Wunder

[11] Patent Number: 5,816,909

[45] Date of Patent: Oct. 6, 1998

[54] DUAL PURPOSE ATTIC FAN

[76] Inventor: Ernie Wunder, 962 Cedar Dr., Newton, N.J. 07860

[21] Appl. No.: 770,339

[22] Filed: Dec. 20, 1996

[51] Int. Cl.[6] ..... F24F 7/06

[52] U.S. Cl. ..... 454/341; 454/355; 454/356

[58] Field of Search ..... 454/341, 347, 454/349, 354, 355, 356

[56] References Cited

U.S. PATENT DOCUMENTS

| | | | |
|---|---|---|---|
| 2,551,004 | 5/1951 | Johnson | 454/341 |
| 2,605,691 | 8/1952 | Euwer et al. . | |
| 2,746,674 | 5/1956 | Alldritt et al. | 454/354 X |
| 4,286,508 | 9/1981 | Seebo, II | 454/354 |
| 4,633,769 | 1/1987 | Milks . | |
| 4,768,424 | 9/1988 | Frenkler et al. | 454/341 |
| 4,941,300 | 7/1990 | Lyons . | |
| 4,977,884 | 12/1990 | Kaufman | 454/354 X |
| 5,330,386 | 7/1994 | Calandra . | |

FOREIGN PATENT DOCUMENTS

| | | | |
|---|---|---|---|
| 88 290 | 9/1956 | Norway | 454/341 |

OTHER PUBLICATIONS

"Power–Flow Obsoletes Other Types or Ventilators", received Dec. 1948, pp. 4–10.

*Primary Examiner*—Harold Joyce
*Attorney, Agent, or Firm*—Michael I. Kroll

[57] ABSTRACT

A dual purpose attic ventilator (10) comprising a hatch (12) with a structure (14) for mounting the hatch (12) on a roof (16) of an attic (18) in a building (20) having an opening (22) therethrough. An attic fan (24) is also provided. A component (26) is for pivoting the attic fan (24) on the hatch (12). A person can open the attic fan (24) on the hatch (12) to climb out through the hatch (12) onto the roof (16) of the building (20). The person can close the attic fan (24) on the hatch (12), to allow the attic fan (24) to pull hot air out of the attic (18) through the hatch (12).

1 Claim, 4 Drawing Sheets

DUAL PURPOSE ATTIC FAN

BACKGROUND OF THE INVENTION

1. Field of the Invention

The instant invention relates generally to ventilating units and more specifically it relates to a dual purpose attic ventilator.

In the home, special ventilation may be required if an occupant is allergic to materials normally found in the air, such as pollen. In this case, the incoming air may be filtered before distribution. For general circulation, exhaust fans may be used to discharge stale air from the building while drawing in fresh air through windows and doors. Attic fans may be used to ventilate closed spaced under a roof. Closed ventilating systems, which do not bring outside air into the home, can assist circulation and, to a smaller extent, heating in the home. Because hot air rises, the upper floors of an open house are likely to be much warmer than the lower ones. The heat can be more evenly distributed through the home by using a re-circulating blower system. Similarly, ceiling fans can redistribute warm air by pushing down the hot air that accumulates near ceilings and providing air movement.

2. Description of the Prior Art

Numerous ventilating units have been provided in prior art. For example, U.S. patents numbered U.S. Pat. No. 2,605,691 to Euwer; U.S. Pat. No. 4,633,769 to Milks; U.S. Pat. No. 4,941,300 to Lyons, Jr. and U.S. Pat. No. 5,330,386 to Calandra all are illustrative of such prior art. While these units may be suitable for the particular purpose to which they address, they would not be as suitable for the purposes of the present invention as heretofore described.

Euwer, Herbert D.

Ventilating Unit

U.S. Pat. No. 2,605,691

An exhaust ventilator for a railway passenger car having a curved roof with an opening cut therein for the passage of air through the roof. A member overlaps the opening and comprises an open, substantially rectangular base frame conforming to the roof curvature. Sides of generally triangular form extends outwardly of the car from the base frame and incline toward each other, both longitudinally and transversely of the car. A top connects the sides and base frame and extends outwardly and downwardly from the upper edge of the base frame. The top and sides terminate in a plane substantially tangent to the roof and lower edge of the base frame and defines an exhaust opening for the passage of air.

Milks, Stephen A.

Roof Vent Fan Assembly

U.S. Pat. No. 4,633,769

A power roof vent fan assembly having a motor and fan mounted in a body spanning an opening in the roof of an enclosure. The motor is mounted in H-shaped cross brace assembly having reinforcing ribs for vibration dampening. A shroud is secured to the body which supports a screen and includes a trim flange which forms a pocket in conjunction with the body. A bezel is telescopically received within the pocket and secured to the lower surface of the roof. A cover is provided over the top end of the assembly which is hinged on one end and adapted to be opened and closed by a cover lifting mechanism located within the pocket. The fan motor is controlled by a speed control switch also located within the pocket. The pocket in which the switch is retained includes ventilation openings for aiding heat dissipation from the switch.

Lyons, Jr., George

Roofing Membrane to Roof Opening Sealing System and Hatchway Employing Same

U.S. Pat. No. 4,941,300

A sealing system is shown for sealing between a waterproof roofing membrane and a curb around a roof opening, including a cap flashing for the cub, a top flange connected to the cap flashing and extending outwardly therefrom and a wall flange connected to the top flange which extends downwardly and forms a filler channel defined by the top flange, the wall flange and the curb. The roofing membrane is held in the filler channel by folding it over a longitudinal resilient filler material sized to fit closely within the filler channel. A plurality of spaced-apart tabs integral with the wall flange are bent into the filler channel beneath the filler material to securely hold the membrane therein without the necessity for any loose fasteners. A preassembled sealing system perimeter frame ready for mounting on an existing curb, a sealing system with an attached hatchway cover, and a complete hatchway with perimeter frame sealing system, cover, curb and associated flashing are also disclosed.

Calandra, Thomas P.

Method and Device for Ventilating a Home

U.S. Pat. No. 5,330,386

A method of installing a ventilation device through existing plywood door closures of accesses to attic spaces with roof fans in home includes a frame with louvers across a central opening closed by two doors hingeably attached to be opened and closed with a hook rod interconnecting with eye bolts on the doors. The entire device is insulated to reduce heat loss during the cooler seasons.

SUMMARY OF THE INVENTION

A primary object of the present invention is to provide a dual purpose attic ventilator that will overcome the shortcomings of the prior art devices.

Another object is to provide a dual purpose attic ventilator that is hinged mounted through a roof of a building, so that it will function as a roof hatch as well as a ventilating device.

An additional object is to provide a dual purpose attic ventilator which is a safe way to gain access onto the roof of a building when opened, so that a person can go onto the roof to clean out gutters and check for leaks without the use of putting a ladder against the gutters or siding.

A further object is to provide a dual purpose attic ventilator that is simple and easy to use.

A still further object is to provide a dual purpose attic ventilator that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
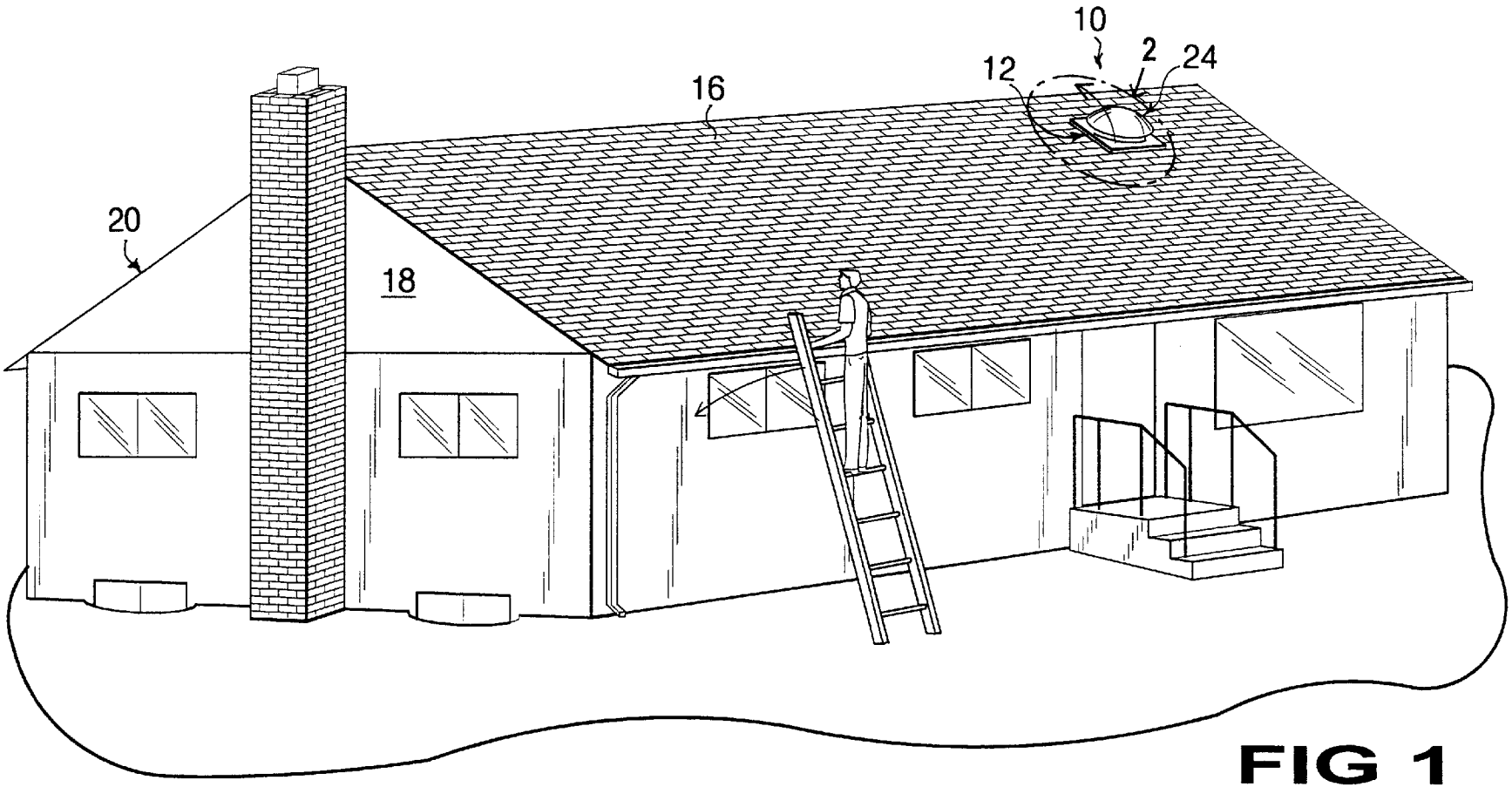
FIG. 1 is a front perspective view of a building with the instant invention installed on a roof.
Figure 2:
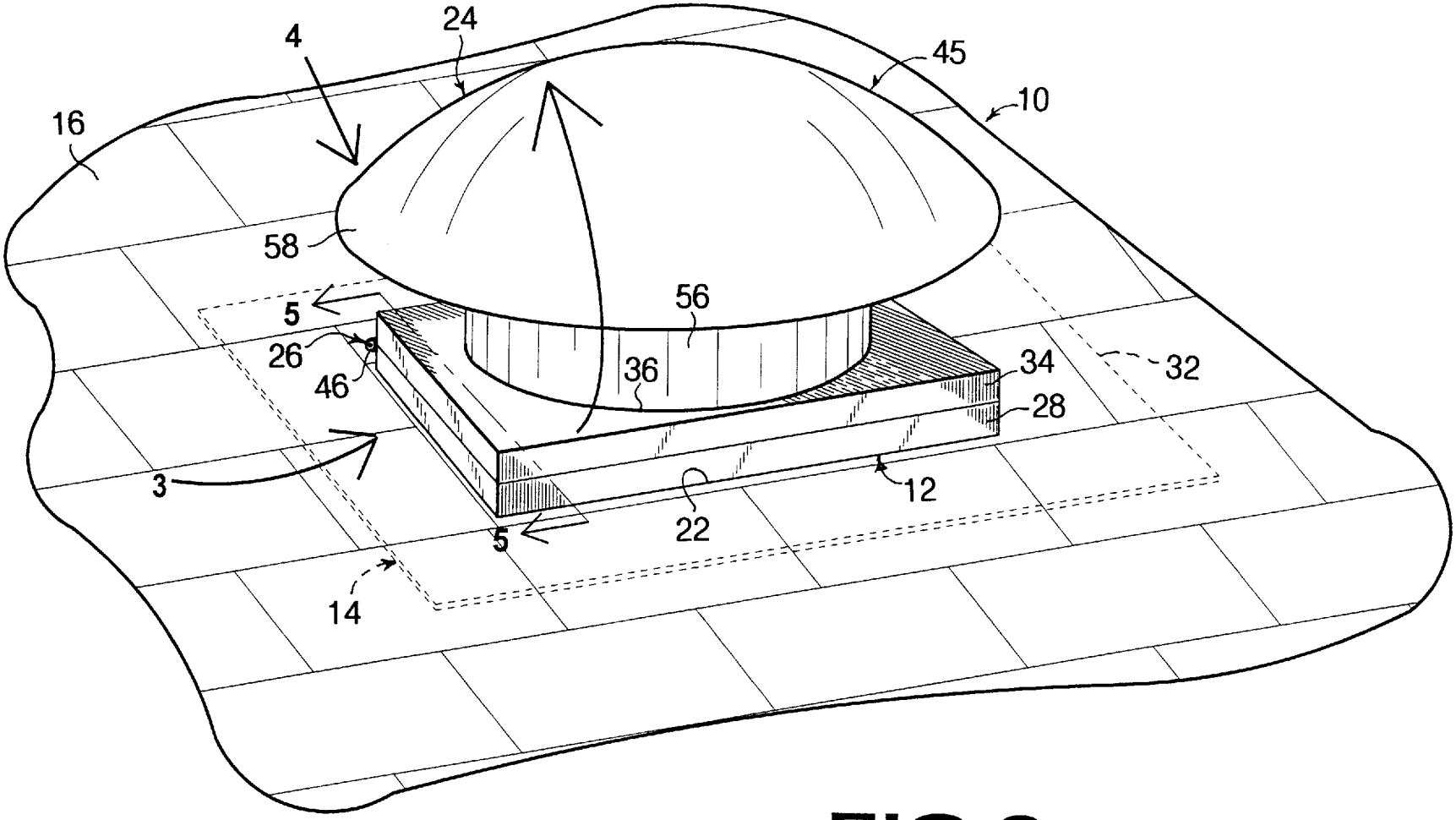
FIG. 2 is an enlarged front perspective view of the instant invention as indicated by arrow 2 in FIG. 1.

Turning now descriptively to the drawings, in which similar reference characters denote similar elements throughout the several views, FIGS. 1 to 5 illustrate a dual purpose attic ventilator 10 comprising a hatch 12, with a structure 14 for mounting the hatch 12 on a roof 16 of an attic 18 in a building 20 having an opening 22 therethrough. An attic fan 24 is also provided. A component 26 is for pivoting the attic fan 24 on the hatch 12. A person can open the attic fan 24 on the hatch 12, to climb out through the hatch 12 onto the roof 16 of the building 20. The person can close the attic fan 24 on the hatch 12, to allow the attic fan 24 to pull hot air out of the attic 18 through the hatch 12.

The hatch 12 includes a box shaped base frame 28 sized to fit into the opening 22 in the roof 16 of the attic 18 in the building 20. A setback top lip 30 is integral with and extends vertically about the perimeter of the box shaped base frame 28. The mounting structure 14 is a flashing 32 extending horizontally outwardly from about the hatch 12, whereby the flashing 32 is affixed onto the roof 16.

The attic fan 24 consists of a box shaped cabinet 34 having a central circular aperture 36 and is sized to fit over the hatch 12. A bottom flange 38 is integral with and extends horizontally inwardly about the perimeter of the box shaped cabinet 34. A bracket support 40 is secured within the central circular aperture 36 in the box shaped cabinet 34. A motor 42 having fan blades 44 is secured centrally to the bracket support 40. A hood assembly 45 is affixed to the box shaped cabinet 34 over the central circular aperture 36. The pivoting component 26 is an elongate hinge 46 between one side of the hatch 12 and one matching side of the attic fan 24, so that the attic fan 24 can swing to an opened and closed position with respect to the hatch 12.

Figure 3:
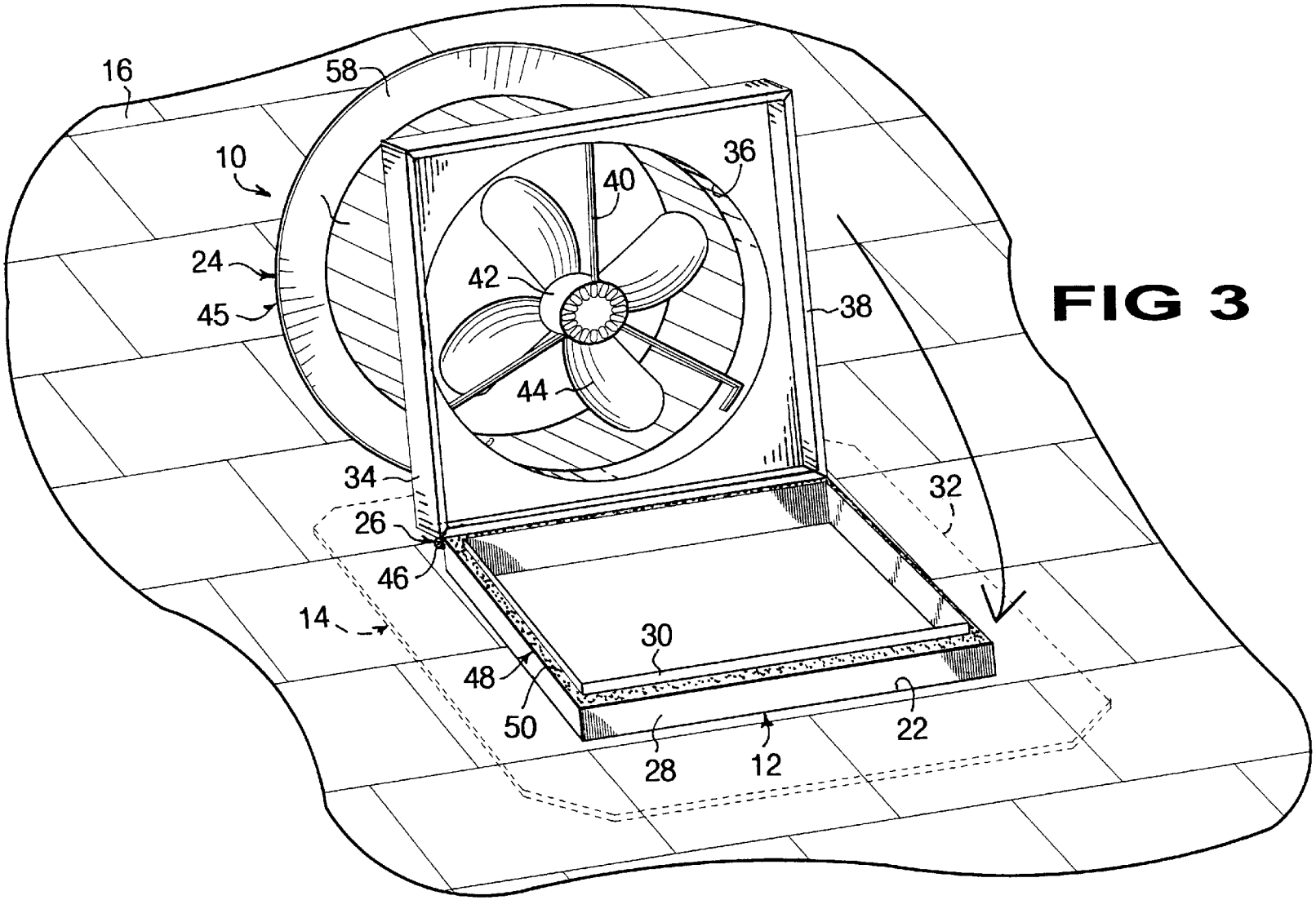
FIG. 3 is an enlarged front perspective view of the instant invention opened as indicated by arrow 3 in FIG. 2.

An element 48, shown in FIG. 3, is for sealing the attic fan 24 to the hatch 12 when in the closed position. The sealing element 48 is a gasket 50 placed between the hatch and the attic fan 24.

Figure 5:
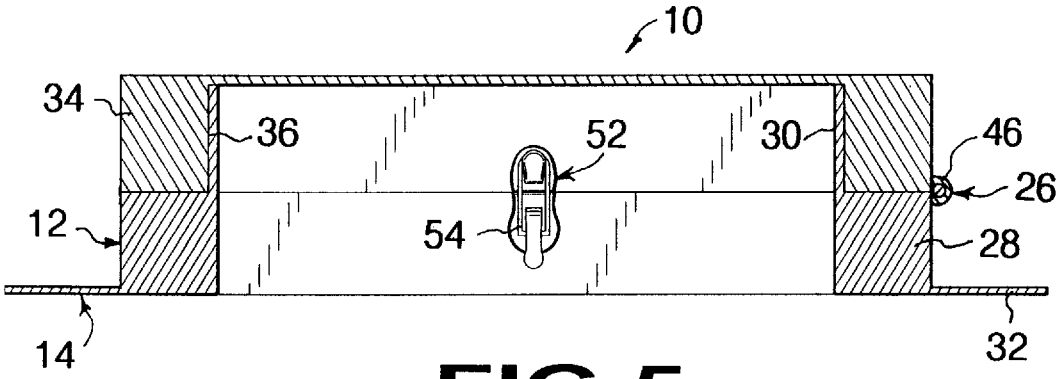
FIG. 5 is a diagrammatic cross sectional view taken along line 5—5 in FIG. 2, showing the internal latch mechanism therein.
Figure 4:
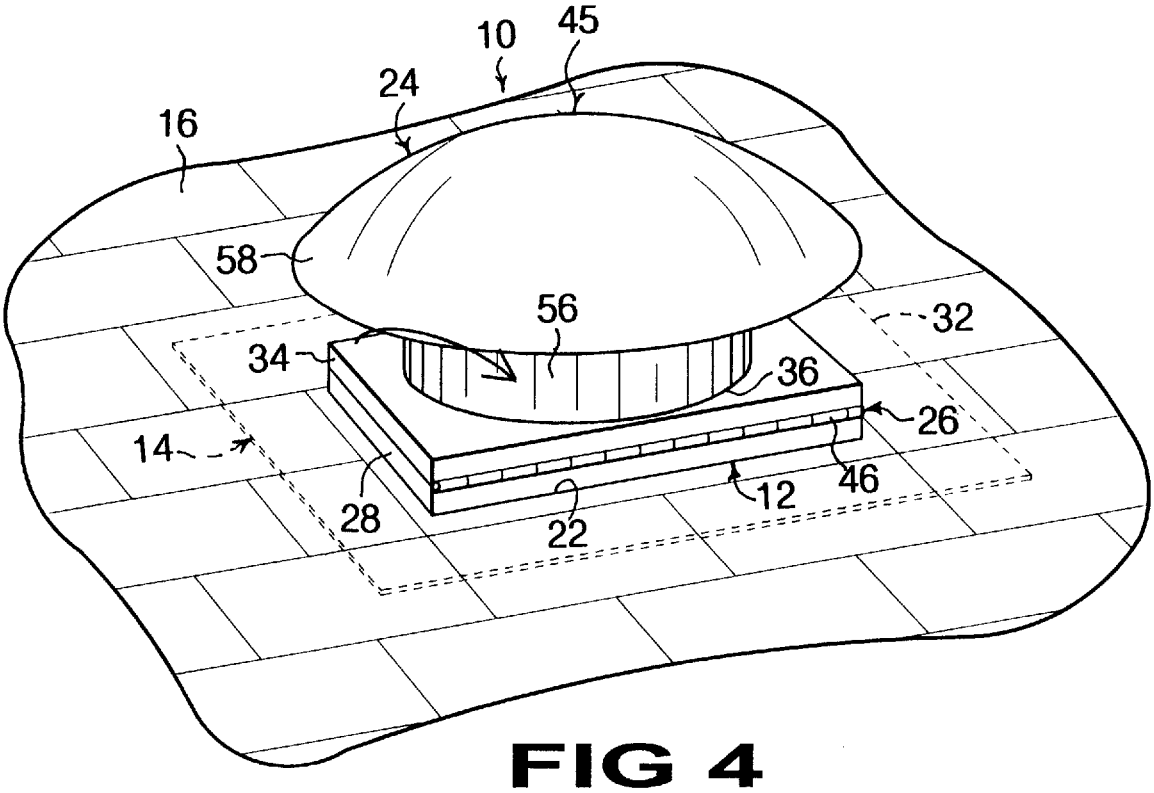
FIG. 4 is an enlarged rear perspective view taken in the direction of arrow 4 in FIG. 2.

A facility 52, as shown in FIG. 5, is for locking the attic fan 24 to the hatch 12, when in the closed position. The locking facility 52 is a latch mechanism 54 mounted internally between the hatch 12 and the attic fan 24.

The motor 42 is a disc-type electric motor. The hood assembly 45 comprises a cylindrical housing 56 mounted onto the box shaped cabinet 34 over the central circular aperture 36. A curved hat 58 is affixed onto the cylindrical housing 56 in a spaced relationship, to allow the hot air to exit therefrom into the atmosphere.

The dual purpose attic ventilator 10 can also be manufactured as a motorless type of attic ventilator to serve in the same manner as one with the attic fan 24.

OPERATION OF THE INVENTION

To use the dual purpose attic ventilator 10, the following steps should be taken:

1. Turn off the attic fan 24 with a service switch installed adjacent thereto.
2. Open the latch mechanism 54.
3. Lift the box shaped cabinet 34 of the attic fan 24 from the box shaped base frame 28 of the hatch 12 by pivoting it on the elongate hinge 46.
4. Climb out through the box shaped base frame 28 of the hatch 12 and onto the roof 16 of the attic 18 in the building 20.
5. Climb back through the box shaped base frame 28 of the hatch 12.
6. Lower the box shaped cabinet 34 of the attic fan 24 back onto the box shaped base frame 28 of the hatch 12 by again pivoting it on the elongate hinge 46.
7. Close the latch mechanism 54.
8. Turn on the service switch, so that the attic fan 24 which is connected to a thermostat will automatically energize when the attic reaches a certain temperature and de-energize when the desired temperature is reached.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A dual purpose attic ventilator comprising:

a) a hatch comprising a rectangular box shaped frame forming a rectangular opening and having a vertically extending lip lining said opening;

b) means for mounting said hatch on a roof of an attic in a building having an opening therethrough permitting communication with the interior of said attic through said hatch;

c) attic fan means comprising a box shaped base sized and shaped to fit on said box shaped frame of said hatch with said base having a rectangular bottom flange surrounding and adjacent said vertically extending lip and in contact with said box shaped frame;

d) hinge means along one common edge of each of said box shaped frame and box shaped base for pivoting said attic fan means on said hatch, so that a person can open said attic fan means on said hatch to climb out through said hatch onto the roof of the building and can close said attic fan means on said hatch, to allow said attic fan means to pull hot air out of the attic through said hatch;

e) said attic fan means further comprising means forming a circular aperture, a bracket support within said circular aperture, disc-type motor means having fan blades secured centrally to and downstream from said bracket support for circulating air out from said attic, and a hood assembly affixed to said box shaped cabinet over the central circular aperture to direct the air being circulated by said fan blades;

f) means comprising a gasket mounted on said frame means for sealing said attic fan means on said hatch when said attic fan means is in the closed position;

g) means for locking said attic fan means from the inside when in the closed position comprising a latch mechanism mounted on said frame and box means in the rectangular opening.

* * * * *